United States Patent [19]

Heddon

[11] Patent Number: 4,801,143

[45] Date of Patent: Jan. 31, 1989

[54] BOWLING LANE CONSTRUCTION

[76] Inventor: Will Heddon, 2000 Dundee Rd., Winter Haven, Fla. 33880

[21] Appl. No.: 927,245

[22] Filed: Nov. 4, 1986

[51] Int. Cl.[4] ..... A63D 1/00; A63D 1/08

[52] U.S. Cl. ..... 273/51; 52/57; 52/DIG. 13; 273/47

[58] Field of Search ..... 273/47, 51; 52/57, 60, 52/DIG. 13; 193/2 R, 2 A

[56] References Cited

U.S. PATENT DOCUMENTS

| | | | |
|---|---|---|---|
| 413,202 | 10/1889 | McCormack | 193/2 R X |
| 428,315 | 5/1890 | Nelson | 52/57 |
| 2,209,082 | 7/1940 | Debay | 273/51 |
| 2,301,778 | 11/1942 | Gremp et al. | 273/51 |
| 3,246,433 | 4/1966 | Eriksson | 52/60 |
| 3,721,050 | 3/1973 | Perina | 52/DIG. 13 |
| 3,798,853 | 3/1974 | Castle | 52/57 |
| 4,015,391 | 4/1977 | Epstein et al. | 52/57 |
| 4,269,411 | 5/1981 | Heddon | 273/51 |

FOREIGN PATENT DOCUMENTS

| | | | |
|---|---|---|---|
| 403596 | 6/1966 | Switzerland | 273/47 |

*Primary Examiner*—Anton O. Oechsle

*Attorney, Agent, or Firm*—Duckworth, Allen, Dyer & Doppelt

[57] ABSTRACT

Disclosed is a bowling lane construction which includes a quick-release return track cover and a return track formed of narrow gauge rails and cross-members which permit foreign objects to fall through the track, and which is installed rapidly and inexpensively. The lane construction further includes a gutter formed of a sheet member of semi-circular cross-section, which is fastened along one side to the adjacent bowling lane, and which ends in a flat gutter of a molded, poly-resinous member which may be easily adapted to lane ends of different configurations and dimensions. The lane construction further provides an impact plate in the ball drop zone to avoid "feather" conditions. A division cap formed of plural sections of a metal shell and a mating core extending centrally through the ends of the metal shell. The entire lane construction is supported by a lateral truss construction which extends at least across each lane and the associated gutters.

19 Claims, 4 Drawing Sheets

67
63
65
69
70
70
70
70
70
66
62
68
64
5
5

64
62
65
63
80

81
82
83
84
80
78
85
86

76
68
74
76
64
70
50
62
76
72
66
76

79
81
71
75
73
81
77

BOWLING LANE CONSTRUCTION

BACKGROUND OF THE INVENTION

1. Field of the Invention

The present invention relates to construction techniques specifically designed for bowling lanes.

2. Description of the Prior Art

Specifications of the American Bowling Congress dictate the dimensions and configuration of a regulation bowling lane. As a result, the particular construction techniques that may be utilized to solve problems associated with prior art bowling lanes are restricted by those specifications.

Typical prior art bowling lane constructions employ a series of sub-plates extending generally lateral to the direction of the bowling lane, with large wooden beams (i.e., 2'×10') extending longitudinally along the direction of the bowling lane. Typically, eight or more of these beams are utilized for each pair of adjacent lanes. Lateral leveling strips are then fixed across the longitudinal beams, and the lane decking is then fixed across the leveling strips. The leveling strips are then utilized to achieve the desired leveling.

American Bowling Congress specifications further require that a gutter be constructed on opposite sides of each of bowling lane, with a division member between the gutters of adjacent lanes A return track for the bowling ball is also required; to this end, it has been customary to extend the return track below the level of the bowling lanes. Typically, the return track is fabricated from flat sheet stock which has been formed in a generally semi-circular cross-section. This track sheet is then fixed below the level of the bowling lane, as described above, and a return track cover is provided to permit access to the return track in the event that a bowling ball becomes stuck along the track. In the past, the return track cover has been formed of a wooden or metal member fastened to anchor strips by conventional fasteners, such as screws and the like. When a bowling ball becomes stuck in a return rack, or the track needs to be repaired or cleaned, some time is required to remove the fasteners and lift the cover.

Gutter constructions for bowling lanes generally consists of two parts: a generally curved, or concave portion alongside the bowling lane and along its length to the pin deck area, and a flat gutter along the pin deck area. Prior art curved gutters consists of a rolled sheet metal member in sections, each rolled sheet metal section having a generally semi-circular configuration with rolled peripheral edges. Such conventional curved gutter constructions are generally joined into adjacent sections by a fastener and strip combination; such a construction is utilized by the Brunswick Corporation of Skokie, Ill. However, the fasteners and joining strips used in the past can, from time to time, work loose and extend above the plane of the curved gutter. When this occurs, a bowling ball rolling along the gutter may be scored. Additionally, such prior art gutters are not fastened to the lane and have gaps which trap dirt and are unsightly; such arrangements, when not fastened from the lane, are also noisy. Further, along the flat gutter portion described above, there may be differences in dimension between previously constructed bowling lanes, and therefore it has been necessary in the past to construct custom-made flat gutter portions.

The decking of a bowling lane usually consists of longitudinal wood strips of hard wood, each strip having a tongue and groove and being joined side to side with fasteners, such as nails, joining adjacent strips. There is a portion of the alley known as the "ball drop zone" that extends in either direction from the foul line. The ball drop zone is that area in which the bowler releases the ball toward the pins at the opposite end of the lane. This ball drop zone is subjected to severe stress, particularly from inexperienced bowlers who release the ball too far above the surface of the lane decking, which results in a rather severe impact as the ball hits the decking surface. The effect of those stresses has been to cause the wooden strips forming the lane decking to tear at the edges and to further separate. This causes the bowling lane surface to deteriorate rapidly in the ball drop area, and further results in treating oils being trapped between adjacent strips. This damage to the surface of the bowling lane decking is commonly referred to as "feather".

It has been known in the past to treat the "feather" problem by drilling a small hole angularly through each wood strip forming the lane decking, and injecting an epoxy adhesive into the interface between adjacent strips. This technique, however, has many difficulties.

SUMMARY OF THE INVENTION

The present invention has as its principal objects and purposes, the provision for a bowling lane construction which avoids many of the difficulties with the prior art bowling lane constructions discussed above.

To this end, a bowling lane construction in accordance with the present invention has a ball return track constructed of a pair of relatively narrow gauge rails of a low friction material, which are fixed generally in parallel configuration along the direction of ball return, and spaced apart a distance less than the diameter of the bowling ball by a series of spaced cross-members. This construction permits foreign objects to fall harmlessly through the track, prevents scoring or damage to bowling balls, and thus avoids impediments to ball return travel. Further, this construction may be installed rapidly and inexpensively.

Further in accordance with the preferred embodiment of the bowling lane construction of the present invention, a quick release ball return track cover is provided over the return track. In this context, the term "quick-release" is intended to mean a cover which can be easily and quickly removed without utilizing a tool, or without the requirement for operating a fastener (such as a wing nut, screw or the like). To achieve this quick release function, the preferred embodiment employs a hook-and-loop fastening mechanism (such as VELCRO®) coupled respectively to anchor strips alongside the ball return track opening and to members extending from the bottom of the return track cover. To achieve a low-cost, light-weight return track cover construction, the cover is preferably fabricated from a thin metal shell having a light-weight foam core with extending members molded integrally with the foam core. The return track cover thus presents a smooth, uninterrupted decorative surface over the return track opening. Suitably, the return track cover is fabricated in sections, with abutting ends of adjacent sections having a male-female relationship so as to facilitate the continuous outside appearance of the return track cover.

In the preferred construction of the return track described above, the track is also fabricated in plural sections which are mated together in a male-female relationship at the opposing extremities thereof. The return track is further provided with a pair of guide rails, each guide rail extending generally along the direction of ball return and fastened to the cross-members, with the return track pair between the two guide rails. The return track is also provided with a downsweep section near the pin deck area of the lane, the downsweep section having at least two downsweep tracks extending generally in the direction of ball return and having means for mating with the pair of low friction tracks forming the main section of the ball return track.

The preferred bowling lane construction of the present invention further comprises gutter means including a sheet member of generally semi-circular cross-sections extending generally parallel with the lane and in each of the gutter openings provided on opposite sides of the lane with fasteners extending through the sheet member and into the adjacent side of the bowling lane decking. The gutter sheet member is formed of plural sections extending along the gutter opening and having means for mating adjacent ones of the section. Suitably, this mating means comprises an indentation at one end of each gutter section for receiving an overlapping relationship the extremity of an adjacent gutter section, so that the overlapped gutter sections together form a relatively smooth surface for bowling balls rolling along the gutter. Each gutter sheet member includes a rolled lip along one extremity adjacent the side of the bowling lane decking, with the fastener extending through the lip and into the adjacent side of the decking.

Each gutter further includes a flat gutter portion adjacent the pin deck area of the bowling lane. In accordance with the present invention, the flat gutter portion comprises a molded member of a high-density polyresin having a flat bowling ball-engaging surface and upstanding sides, the molded member having a molded support structure under the ball-engaging surface with a molded grid of longitudinal and lateral support legs.

As noted above with respect to the prior art, a typical pair of bowling lanes is separated by a structure referred to as a "division" atop which rests a decorative member known as a division cap. In accordance with the present invention, there is provided a decorative division cap formed of plural sections of a metal shell and means for mating adjacent sections of the division cap so as to achieve a continuous, relatively uninterrupted appearance to the division cap along the direction of the bowling lane toward the pin deck area. To this end, the division cap is provided with a core extending through each division cap section with a protrusion at one end of each section and a void at the other end, whereby a protrusion of one section mates with a void of an adjacent section.

To avoid the difficulties associated with the "feather" problem discussed above, the bowling lane construction of the present invention provides a feather block in the form of an impact plate extending across the underside of the bowling lane decking in the ball drop zone, in order to spread the ball impact across all of the decking strips in that zone.

DETAILED DESCRIPTION OF THE PREFERRED EMBODIMENT

A detailed description of the preferred embodiment of a bowling lane construction in accordance with the various aspects of the present invention will now be described with reference to the drawings.

Figure 1:
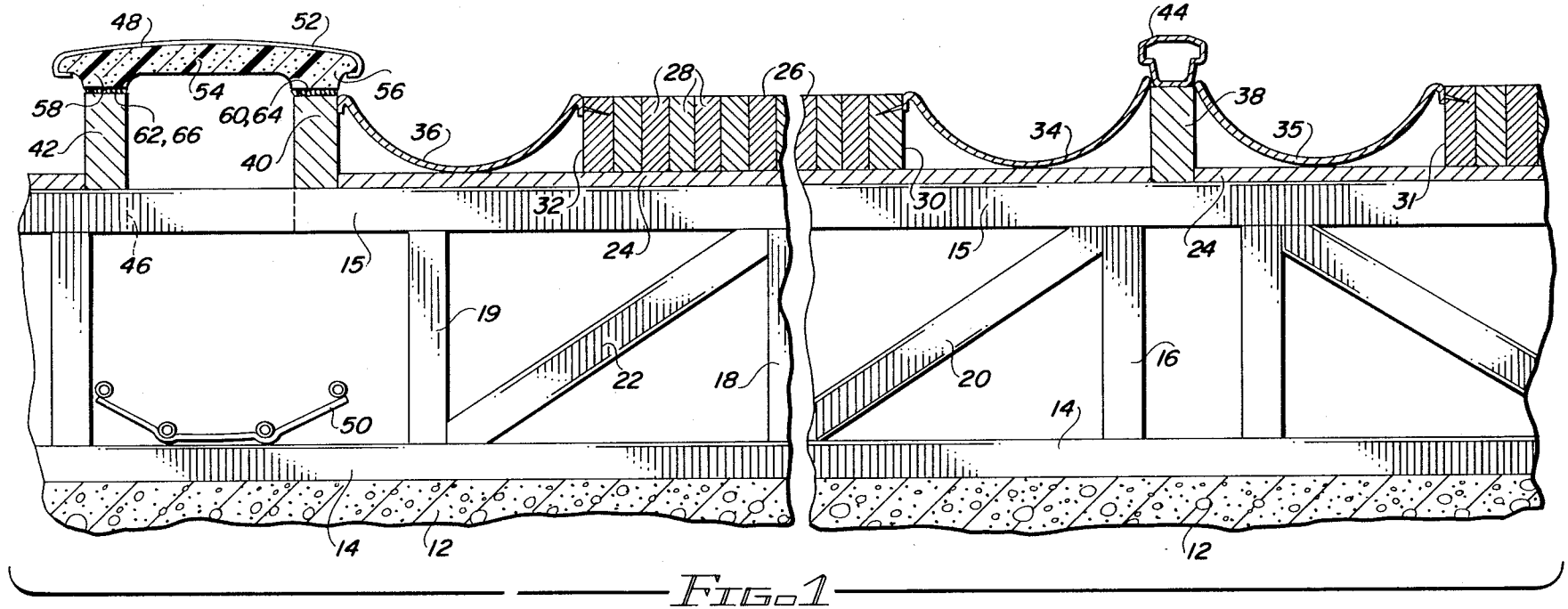
FIG. 1 is an end view, in cross-section, of a bowling lane construction in accordance with the present invention.

First, noting FIG. 1, a bowling lane construction in accordance with the present invention is referred to generally by the reference numeral 10 and is adapted to be fabricated atop a conventional foundation 12, for example, a poured slab of concrete. Plural trusses, one of which is shown in FIG. 1, are provided to support each bowling lane; one truss shown in FIG. 1 includes lateral cross members 14 and 15; vertical support 16, 17, 18 and 19; and diagonal braces 20, 21, and 22. Each truss including the respective cross-members, vertical braces and diagonal braces may be fabricated using conventional truss technology. A layer of a fabric material, such as CELOTEX ®, is extended across the tops of all of the upper cross members 15.

Figure 14:
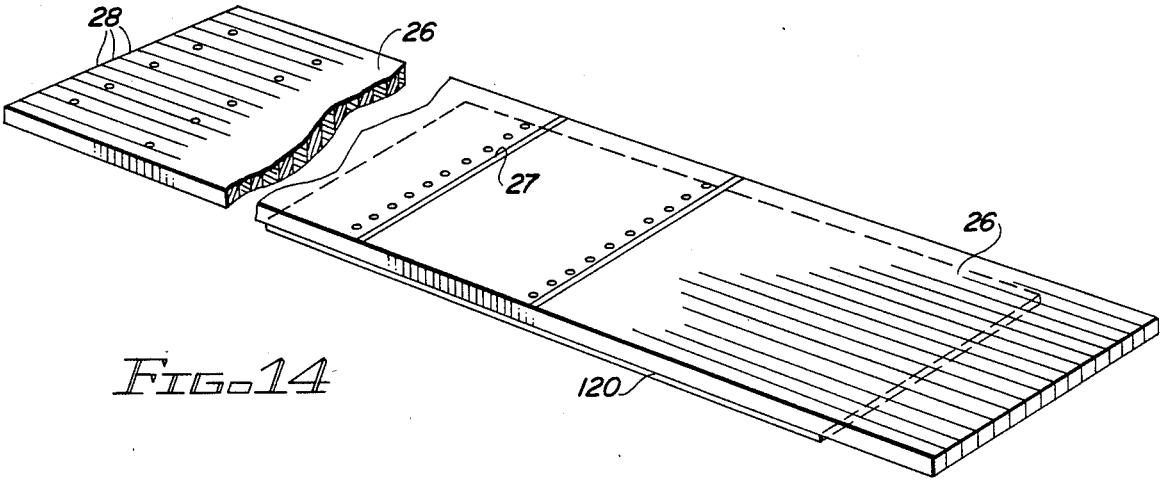
FIG. 14 illustrates a feather block impact plate according to the present invention.

A bowling lane 26 fabricated of abutting strips 28 of alley decking extends longitudinally down the direction of the bowling lane (see FIG. 14). An adjacent bowling lane 27 is similarly fabricated from conventional alley decking. The two adjacent bowling lanes 26, 27 are separated by two gutter openings 30, 32 defined by the respective sides of the bowling lanes 26, 27; a similar gutter opening 32 extends alongside the bowling lane 26. The adjacent gutters 30, 31 are separated by an anchor strip 38. Similar anchor strips 40, 42 extend longitudinally along the direction of the bowling lane 26, and over a ball return track 50, which is described in greater detail below with reference to FIGS. 4, 5, 6 and 7. The upper cross-member 15 of the lateral trusses define an opening 46 extending between the respective cross-members, which opening serves as an access to the ball return track 50 between the anchor strips 40 and 42. A quick release ball return track cover 48 is positioned over the opening 46 between the anchor strips 40, 42 in order to enable the bowling alley operator to quickly obtain access to the return track 50 when bowling balls become stuck therein, or the return track is to be cleaned or repaired. The specific details of the return track cover are described below with reference to FIGS. 2 and 3.

Referring again to the right hand side of FIG. 1, a decorative division cap 44 is positioned atop the anchor strip 38. The construction details of the division cap 44 are described below with rreference to FIGS. 15 and 16.

The bowling lane construction 10 includes gutter sections 34, 35 and 36 disposed respectively in the gutters 30, 31 and 32. Each gutter section, as shown in FIG. 1, comprises a formed metal sheet having a semi-circular cross-sectional configuration, with each gutter section fastened to an adjacent side of the respective bowling lane 26, 27. The specific construction details of the gutter, including the flat gutter portion and the pin deck area, are described below with reference to FIGS. 8–13.

It will be understood by those skilled in the art that the sectional view of the bowling construction 10 of FIG. 1 is taken in that area between the ball drop zone and the pin deck area. As is described below with specific reference to FIG. 14, the bowling lane construction 10 is further provided with a feather block which is designed to avoid the "feather" problem discussed above. The specific details of the feather block will be described with reference to FIG. 14.

Further, it will be understood that the bowling construction 10 also includes conventional ball return equipment at the end of the return track 50, which is not described here.

Figure 3:
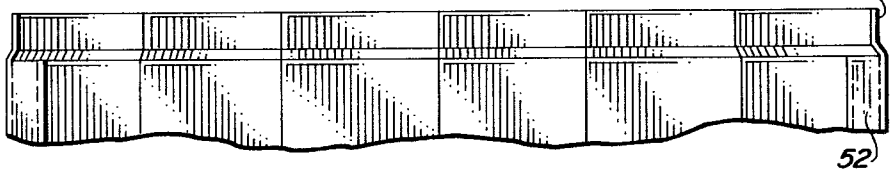
FIG. 3 is an end view of a portion of the quick release ball return track cover shown in FIG. 2.

The construction details of the ball return track cover 48 will now be described with reference to FIGS. 2 and 3.

Figure 2:
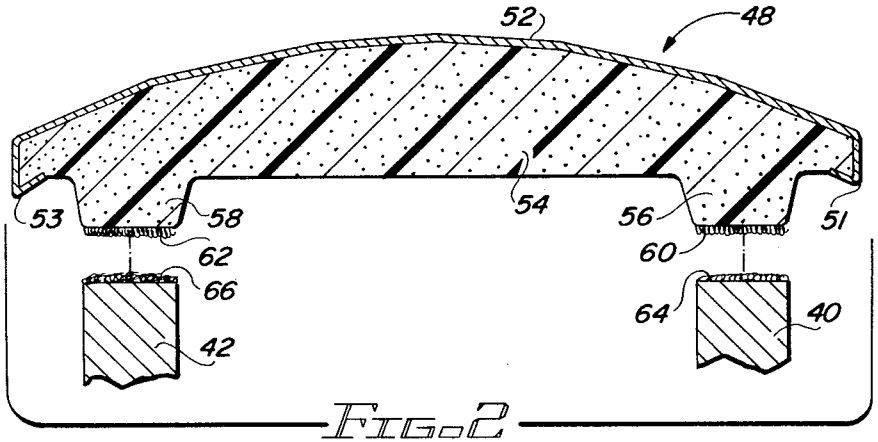
FIG. 2 illustrates a cross-section of a quick release ball return track cover in accordance with the present invention.

First, noting FIG. 2, the quick release ball return cover 48 is fabricated from an outer shell 52 of thin-guage metal, preferably aluminum, which may either be extruded or cold rolled. A light-weight foam core 54 is molded into the shell 52, to provide a light-weight characteristic to the return track cover 48, and with the core 54 having outwardly extending legs 56 and 58 molded therewith. The extending legs 56 and 58 dimensionally correspond to the anchor strips 40 and 42 which define the ball return track opening 46 (FIG. 1). In accordance with the present invention, each of the opposing anchor strips 40 and 42, and extending legs 56, 58 are provided with a compatible quick release fastener, such as VELCRO®, or another suitable hook-and-loop fastener. In the example of FIG. 2, anchor strip 40 and extending leg 56 are provided with mating hook-and-loop fasteners 64 and 60, respectively; and anchor strip 42 and extending leg 58 are provided with mating fasteners 66 and 62, respectively. It will thus be understood that the return track cover 48 is provided with a quick release means by which a section of the return track cover may be removed to expose the return track opening 46, and thus the return track 50, without the use of conventional tools such as screw drivers or the like, or without the requirement for operating a fastener, such as a wing nut, screw or the like. Rather, the bowling alley operator may quickly and easily remove the return track cover 48 of FIG. 2 by extending the fingers of one hand underneath either of the rolled ends 51, 53 of the metal shell 52, and thereafter pulling the cover 48 away from the anchor strip 40, 42 by releasing the hook-and-loop fasteners defined by element 60, 62, 64 and 66.

In order to fabricate the return track cover 48 in a sectionalized form, but in a manner which permits the return track cover to have a clean, relatively uninterrupted decorative appearance, mating means are provided for adjacent sections of the return track cover. Noting FIG. 3, the mating means comprises an indentation 53 along the outer metallic shell 52, and with a corresponding void in the core 54 of an adjacent section of the sectionalized return track cover. In this way, the indentation 53 mates underneath the metal shell 52 at the adjacent end of the next section of return track cover, to achieve the desired appearance of a continuous, relatively uninterrupted decorative outer surface.

The ball return track 50 in accordance with the construction of the present invention will now be described with reference to FIGS. 4–7, inclusive. Noting FIGS. 4 and 5, the return track 50 includes a pair of generally parallel tracks 62, 64 extending along the direction of ball return, and with a pair of guide rails 66, 68 each extending along the outside of the respective adjacent track 62, 64. The return track 62, 64 and guide rails 66, 68 are held in a generally longitudinal configuration by plural cross-members 70 which extend generally lateral to the direction of ball return and which are of a relatively thin gauge in order to create a series of voids between adjacent cross-members and their respective return tracks 62, 64 and guide rails 66, 68. In this way, foreign objects pass through the return track and do not impede ball return.

Figures 4, 5, 5A, 6, 7:
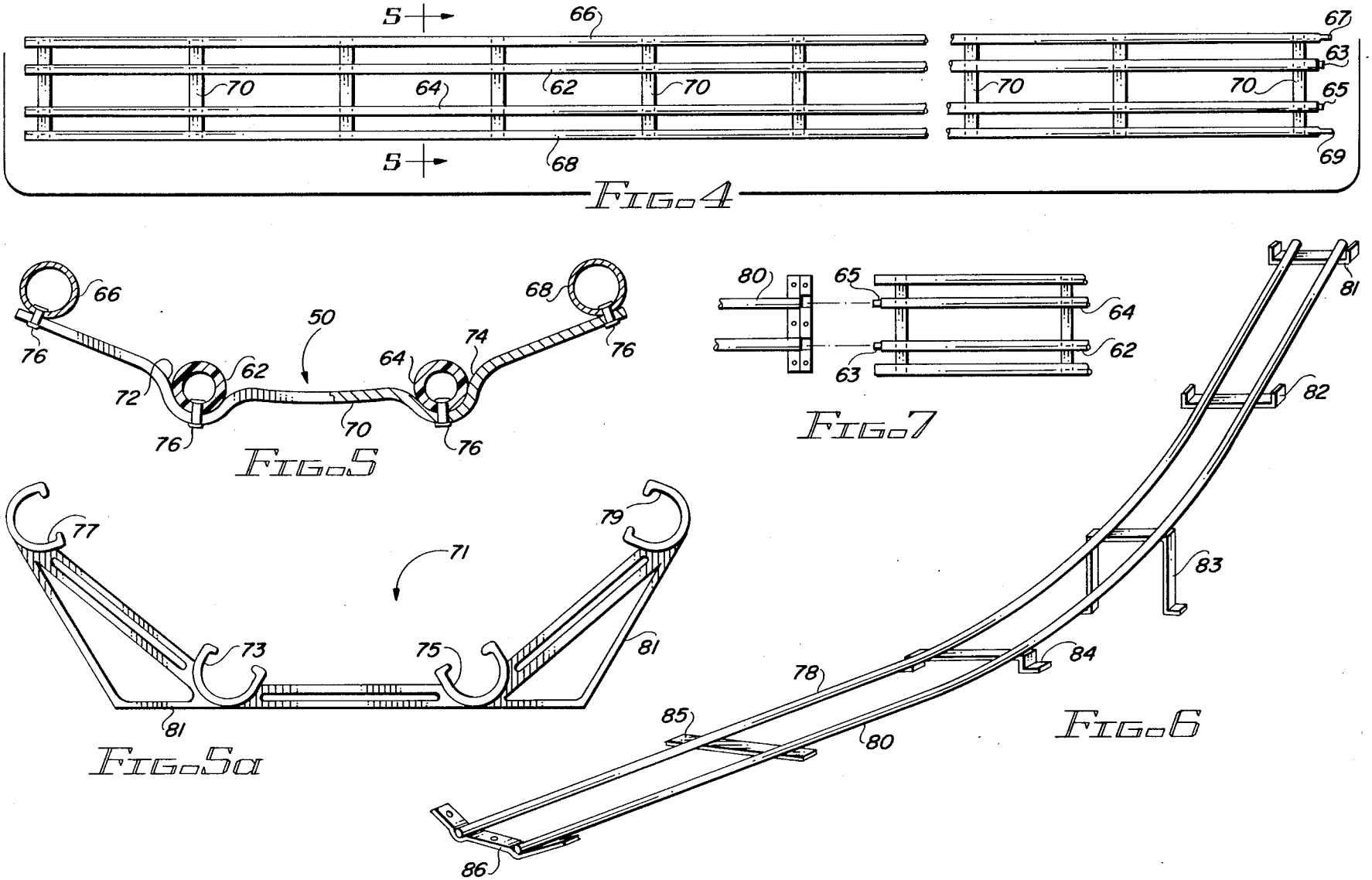
FIG. 4 is a top plan view of a section of ball return track constructed in accordance with the present invention.
FIG. 5 is a cross-sectional end-view of the section of ball return track shown in FIG. 4, taken along the cross sectional lines 5—5.
FIG. 5*a* is an end view of an alternate construction for a portion of the return track shown on FIG. 5.
FIG. 6 is a perspective view illustrating the downsweep portion of the ball return track.
FIG. 7 is a top plan view illustrating the manner in which the downsweep track section of FIG. 6 is coupled with a flat ball return track section, such as that shown in FIG. 4.

As is specifically shown in FIG. 5, each cross-member is provided with at least two indentations 72, 74 which are dimensioned to receive the return tracks 62 and 64, respectively. The indentations 72, 74 (and thus the return tracks 62, 64) are spaced apart a distance which is less than the diameter of a bowling ball (shown in dotted line in FIG. 5), and such that a center line of the bowling ball extends between the two return tracks 62 and 64 as the ball rolls along the return track. The guide rails 66, 68 and return tracks 62,64 are fastened to each cross-member 70 via fasteners, such as rivets 76 in FIG. 5.

An alternate form of construction for the cross-member 70 of FIG. 5 is shown in 5*a*. The alternate cross-member 71 has integral brace members 81 under the portion extending between track snap locks 73, 75 and guide rail snap locks 77, 79. The snap locks avoid the need for rivets.

In order to permit each section of return track, such as the section shown in FIG. 4, to be coupled with an adjacent section of return track, each return track 62, 64 and guide rail 66, 68 is provided with a male member 63, 65, 67 and 69, respectively, at one end thereof. Each of the male members 63, 65, 67 and 69 interconnect with a void at an end of an adjacent return track section.

The return track member 50 of the bowling lane construction in accordance with the present invention also includes a downsweep section which is shown in FIGS. 6 and 7. This downsweep section includes a pair of generally parallel tracks 78, 80 and cross-members 81–86, inclusive. As is shown in FIG. 7, the two return tracks 78, 80 of the downsweep section of FIG. 6 is interconnected with the return track 62, 64 of the first return track section, and is mated therewith via male extensions 63, 65 at one end of that return track section.

Figure 8:
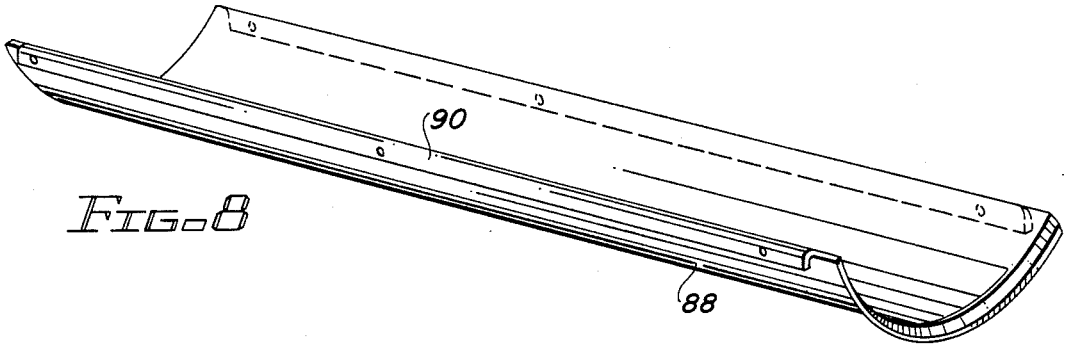
FIG. 8 is a perspective view illustrating a gutter section in accordance with the present invention.
Figure 9:
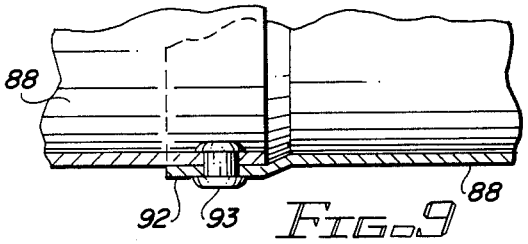
FIG. 9 is a broken away portion of two mated gutter sections in accordance with the present invention.
Figure 10:
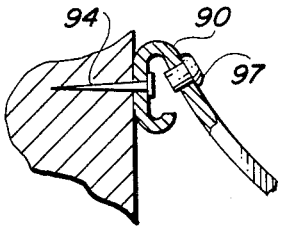
FIG. 10 is a broken-away, cross-sectional illustration of a portion of the gutter section shown in FIG. 8.

Referring now to FIGS. 8, 9 and 10, there is shown a preferred gutter construction for the bowling lane of the present invention. The gutter construction includes a sheet metal member 88 having a generally circular cross-section, and which is provided with a rolled lip along one extremity thereof. As is shown in FIG. 10, the rolled lip 90 comprises two generally parallel portions, with fastener openings extending through both portions, so that the outside portion of the rolled lip 90 engages a fastener 94 which extends into the adjacent side of the decking defining the bowling lane 26 (FIG. 1). A hole cover 97 in the inner fastener opening prevents the screw 94 from backing into the gutter.

In order that the gutter section 34 of FIG. 8 is able to mate with an adjacent gutter section, one end of the gutter section 34 is provided with an offset 92, shown in detail in FIG. 9. The offset 92 extends toward the ball drop zone and away from the pin deck area, and thus permits one extremity of the next adjacent gutter section 88 to overlap in the offset 92, and thereby present a relatively smooth, uninterrupted surface to bowling balls rolling along each gutter section 34. The overlapped ends are joined by a pop rivet 93 extending through holes shown but not numbered in FIG. 9). It will be understood that adjacent gutter sections are free of fasteners connected at the mated ends thereof, except at the upper extremity opposite the one extremity to which each gutter section is attached to the decking.

Figure 11:
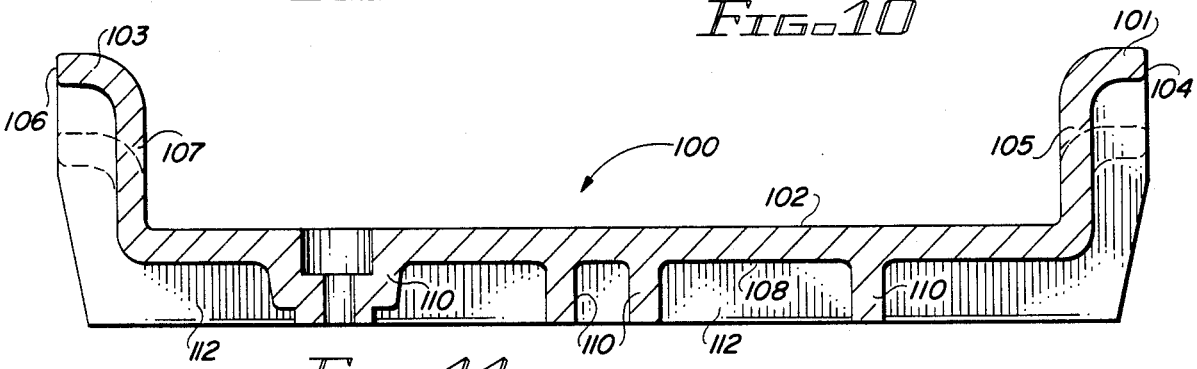
FIGS. 11, 12 and 13 illustrate end, top and side views, respectively, of a molded flat gutter section in accordance with the present invention.
Figure 12:
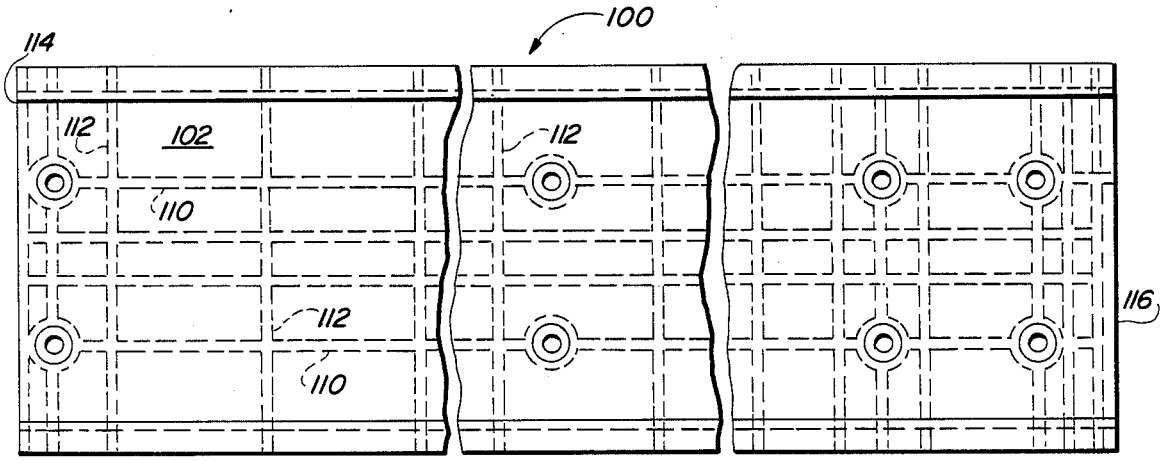
Figure 13:
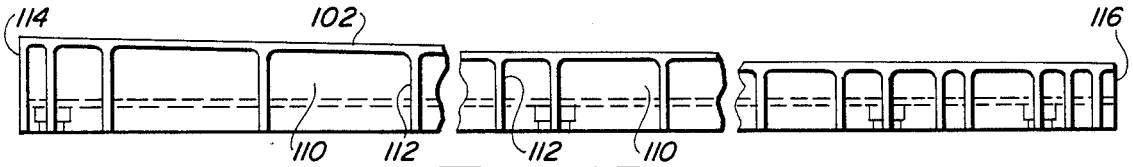

Turning now to FIGS. 11, 12 and 13, there is shown a flat gutter section 100 which is adapted to extend beyond the last generally semi-circular gutter section 34 of the type shown in FIG. 8, adjacent the pin decked area of the bowling lane 26. As is described above, the dimensions of the flat gutter section vary, and it is therefore the function of the flat gutter section 100 to provide a facile flat gutter section which may be trimmed for different dimensional requirements without the requirement for a customized, and thus expensive, construction. To this end, the flat gutter section 100 of FIGS. 11, 12 and 13 is formed of a molded poly-resinous material which can be trimmed at its extremities. The molded flat gutter section 100 includes a flat gutter surface 102 which is adapted to support a bowling ball; it will also be understood by those skilled in the art that the poly-resinous material of which the flat gutter section 100 is fabricated may be made from high impact plastics, because of the rigorous impact requirements for the flat gutter section.

The flat gutter section 100 is further provided with upstanding sides 104 and 106, which comprise a generally vertical section 105 and 107, respectively, and an outwardly extending horizontal section 101 and 103, respectively. The flat gutter section 100 further includes a grid of longitudinal and lateral support legs 110 and 112, which are fabricated in the molding process and are integrally connected together (note FIG. 12). As is shown in FIG. 13, the flat gutter section 100 tapers downwardly from the end toward the ball drop zone, and toward the end 116 furtherest from the ball drop zone. The use of a flat gutter section 100 fabricated from a solid, integrally molded member of a high impact plastic permits the flat gutter section 100 to be dimensionally trimmed, as required to fit within a bowling lane having dimensional variations, while maintaining the structural integrity of the flat gutter section.

FIG. 14 discloses the "feather block" impact plate 120 which is positioned underneath all of the lane decking strips 28 in the area of the ball drop zone, which extends on opposite sides of the foul line 27. The impact plate 120 may be adhesively bonded to the bottom side of the decking strips forming the lane 26, or may alternatively be fastened by other means. It will be understood that the impact plate 120 serves to spread the shock of a ball drop impact across the entire lane, and thereby reduce the damage to the lane at any particular point.

Figure 15:
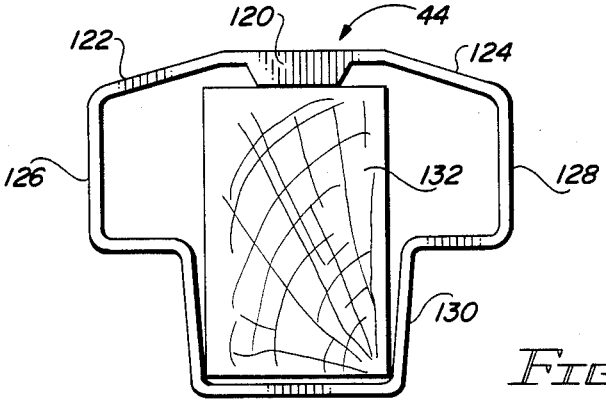
FIGS. 15 and 16 are front and perspective views, respectively, of a division cap according to the present invention.
Figure 16:
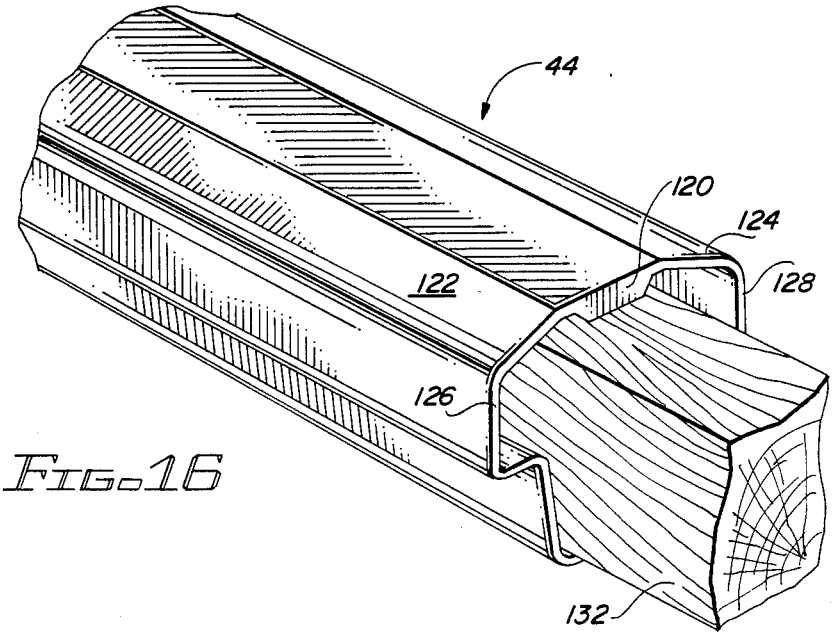

Noting FIGS. 15 and 16, the decorative division cap 44 is fabricated from a metal (preferably aluminum) extrusion 120 having tapered upper surfaces 122, 124; flared sides 126, 128 and a lower extension 130. A male member 132 extends through the extrusion 120 and beyond the extremity thereof to mate with the next adjacent section of the division cap 44.

It will thus be understood that a bowling lane incorporating all of the features and modifications discussed above provides a relatively low-cost, fascile construction which avoids any of the difficulties associated with prior art bowling lane constructions.

I claim:

1. A bowling lane construction, comprising:

bowling lane supporting means adapted for mounting on a sub-foundation and having an upper support surface;

decking for at least one bowling lane extending over said support surface and defining a gutter opening on opposite sides of said lane;

gutter means in each of said gutter openings;

ball return track means extending generally parallel with said lane and gutters and through the level of said supporting means and below said support surface;

said support surface defining a return track access opening extending over said return track means;

anchor strips along said support surface on opposite sides of said return track access opening; and quick-release cover means over said return track access opening, said cover means including a metallic outer shell, a foam core within said shell and imparting a light-weight characteristic to said cover means, and quick-release fastening means attached with said cover and said anchor strips, whereby said cover means may be quickly attached to and released from said anchor strips, said shell being sectionalized to fit in sections along said return track access opening, and wherein said shell includes means for mating adjacent sections thereof.

2. The bowling lane construction recited in claim 1 wherein said quick-release fastening means comprises a hook-and-loop fastener.

3. The bowling lane construction recited in claim 1 wherein said return track means comprises at least two low-friction tracks extending along the direction of ball return, each track being relatively narrow with respect to a bowling ball and being fixed with respect to each other a dimension less than the diameter of a bowling ball, such that the center line of a bowling ball rolling along said tracks extends between said tracks.

4. The bowling lane construction recited in claim 3 wherein said return track means further comprises plural cross-members extending generally transverse to the direction of ball return and under said two tracks for support thereof.

5. The bowling lane construction recited in claim 4 wherein each of said cross-members has spaced indentations, each for receiving one of said tracks.

6. The bowling lane construction recited in claim 5 wherein said return track means further comprises a pair of guide rails, each guide rail extending generally along the direction of ball return with said tracks therebetween, each guide rails fastened to each of said cross-members.

7. The bowling lane construction recited in claim 6 wherein the return track means further comprises each of said tracks and guide rails being fastened to each of said cross-members, each tracks so fastened to each cross-member in the corresponding one of said indentations.

8. The bowling lane construction recited in claim 6 wherein said ball return track means comprises plural sections, with each section having means for mating with an adjacent section at the extremities of said tracks and guide rails such that, after mating, said tracks present a relatively smooth, relatively uninterrupted low-friction surface for bowling balls rolling thereon.

9. The bowling lane construction recited in claim 6 wherein said ball return track means comprises a ball downsweep section near one end of said bowling lane, said downsweep section having at least two downsweep tracks extending generally in the direction of ball return, said downsweep tracks having means for mating with said low friction tracks.

10. The bowling lane contruction recited in claim 1 wherein each gutter means comprises:

a sheet member of generally semi-circular cross-section extending generally parallel with said lane and in each of said gutter openings; and means for fastening said sheet member along an adjacent side of said decking.

11. The bowling lane construction recited in claim 10 wherein each said gutter means further comprises each said sheet member having plural sections along each said gutter opening and having means for mating adjacent ones of said sections.

12. The blowing lane construction recited in claim 11 wherein said gutter mating means comprises:

a formed indentation at one end of each gutter section for receiving in overlapping relation an extremity of an adjacent section, whereby the overlapped sections together form a relatively smooth surface for bowling balls rolling along said gutter means; and means for fastening said overlapped extremities together.

13. The bowling lane construction recited in claim 10 wherein each of said gutter means further comprises:

a rolled lip along one extremity of said sheet member adjacent the side of said lane decking, whereby said rolled lip provides two generally parallel portions of said sheet member at said one extremity; and wherein said fastening means extends through said lip and into the adjacent side of said decking.

14. A bowling lane construction, comprising:

bowling lane supporting means adapted for mounting on a sub-foundation and having an upper support surface;

decking for at least one bowling lane extending over said support surface and defining a gutter opening on opposite sides of said lane; and gutter means in each of said gutter openings, wherein each said gutter means comprises a flat gutter adjacent to the end of said lane, said flat gutter comprising a unitary molded member of a high-density polyresin having a flat bowling ball-engaging surface and upstanding sides, said molded member having a unitary molded support structure under said ball-engaging surface, said support structure including a molded grid of longitudinal and lateral support legs.

15. A bowling lane construction, comprising:

bowling lane supporting means adapted for mounting on a sub-foundation and having an upper support surface;

decking for at least one bowling lane extending over said support surface and defining a gutter opening on opposite sides of said lane;

gutter means in each of said gutter openings;

additional decking for a second bowling lane extending generally parallel with said one bowling lane, and with a gutter adjacent to and extending generally parallel with one of said gutters of said one bowling lane;

an anchor strip between said one gutter of said one bowling lane and said adjacent gutter of said second bowling lane; and a decorative division cap atop said anchor strip, said division cap formed of plural sections of a metal shell and means for mating adjacent sections of said division cap, said mating means including a core extending through each section of said division cap, said core forming a protrusion at one end of each section and a void at the other end, whereby a protrusion of one section can be extended into a void of an adjacent section, and means for fastening said division cap to said anchor strip.

16. The bowling lane construction recited in claim 1, wherein said bowling lane decking defines a ball drop zone along the portion thereof, said construction including means for spreading the impact of balls dropped in said dropped zone across all of the decking forming said lane.

17. The bowling lane construction recited in claim 16 wherein said impact spreading means comprises a feather block formed of an impact plate fastened to said decking and carried by said supporting means across substantially all of said decking in said ball drop zone.

18. A bowling lane construction comprising:

bowling lane supporting means adapted for mounting on a sub-foundation and having an upper support surface;

decking for at least one bowling lane extending over said support surface and defining a pair of gutter openings, each on an opposite side of said lane;

a gutter of a generally semi-circular cross-section positioned longitudinally in each gutter opening and extending parallel with said lane, each gutter formed of plural sections mated end to end in overlapping relation;

means for laterally fastening each gutter section to said decking, said lateral fastening means extending through each said gutter section and into said decking along an upper extremity of said gutter section; and wherein adjacent gutter sections are free of fasteners at the mated ends thereof, except at said upper extremity opposite said one extremity to which each said gutter section is attached to said decking.

19. A bowling lane construction comprising:

bowling lane supporting means adapted for mounting on a sub-foundation and having an upper support surface defining a return track access opening;

decking for at least one bowling lane extending over said support surface;

a ball return track assembly extending generally parallel with said lane and through the level of said supporting means and below said access opening in said supporting surface, said return track assembly including:

at least two low-friction tracks extending along the direction of ball return, each track being relatively narrow with respect to a bowling ball and being fixed with respect to each other a dimension less than the diameter of a bowling ball, such that the center line of a bowling ball rolling along said tracks extends between said tracks, a pair of guide rails, each guide rail extending generally along the direction of ball return with said two tracks therebetween, plural cross-members extending generally transverse to the direction of ball return and under said pair of tracks and said pair of guide rails for support thereof, each cross-member including a snap-lock adjacent the respective one of said tracks and rails for locking said rails and tracks therein; and quick-release cover means positioned over said return track access opening, said cover means being sectionalized to fit in sections along said return track access opening and including means for mating adjacent sections thereof, and further including a metallic outer shell;

a foam core within said shell and imparting a lightweight characteristic to said cover means; and quick-release fastening means attached with said cover and with said bowling lane supporting means whereby said cover and with said bowling lane supporting means whereby said cover means may be quickly attached to and released from said supporting means.

* * * * *